US005964253A

United States Patent [19]

Fumex

[11] Patent Number: 5,964,253

[45] Date of Patent: Oct. 12, 1999

[54] FASTENING SYSTEM FOR A DOBBY SUSPENSION LEVER PULLING CABLES

[75] Inventor: Andre Fumex, Talloires, France

[73] Assignee: Staubli Faverges, Faverges, France

[21] Appl. No.: 09/042,533

[22] Filed: Mar. 17, 1998

[30] Foreign Application Priority Data

Mar. 26, 1997 [FR] France ..... 97 03968

[51] Int. Cl.[6] ..... D03C 1/14

[52] U.S. Cl. ..... 139/88; 139/82; 403/157; 24/122.6; 24/129 W

[58] Field of Search ..... 174/94 R; 403/157; 474/177; 139/88, 82; 24/122.6, 122.3, 129 W, 132 AA

[56] References Cited

U.S. PATENT DOCUMENTS

| | | | |
|---|---|---|---|
| 2,641,810 | 6/1953 | Gasink | 24/126 |
| 2,884,478 | 4/1959 | Becker et al. | 174/94 |
| 4,226,550 | 10/1980 | Kupcak et al. | 403/157 |
| 5,036,164 | 7/1991 | Schrader et al. | 174/94 R |
| 5,143,124 | 9/1992 | Froment . | |

FOREIGN PATENT DOCUMENTS

| | | |
|---|---|---|
| 0245102 | 11/1987 | European Pat. Off. . |
| 0457696 | 11/1991 | European Pat. Off. . |
| 0612872 | 8/1994 | European Pat. Off. . |

*Primary Examiner*—Andy Falik
*Attorney, Agent, or Firm*—Dowell & Dowell, P.C.

[57] ABSTRACT

The ends of two cables associated with a suspension lever in a negative dobby for controlling a common held frame are fixed in a ferrule of an eyelet which is shaped to engage a fastening section provided on a terminal edge of the lever.

5 Claims, 2 Drawing Sheets

FASTENING SYSTEM FOR A DOBBY SUSPENSION LEVER PULLING CABLES

BACKGROUND OF THE INVENTION

1. Field of the Invention

The present invention relates to the negative type weaving dobbies for the shed forming on weaving looms and it deals more specifically with the fastening of the pulling cables on the suspension levers associated with the heald shafts frames.

2. Brief Description of the Related Art

The object of document EP-A-0 457 696 (STAUBLI) is a fastening system that comprises, on the one hand, a terminal eyelet for each pulling cable of the dobby that is secured to a hollow ferrule of an axial housing for the crimping of the end of said cable and, on the other hand, a bearing pad having at least one longitudinal groove for the purpose of taking up this cable directly behind the eyelet. The pad is designed so as to be held against the terminal edge of the contemplated suspension lever, while each eyelet is secured by a removable pin on the aforementioned edge.

Such a fastening system has been proven satisfactory on a practical plan but its utilization revealed its limitations.

As a matter of fact, the displacement loads and speeds of the pulling cables become greater at all times which entails having to resort to cables with a greater diameter. Well now, the available space on each suspension lever is very reduced because of the slight thickness of these elements, coupled with a limited reciprocal spacing; therefore, it is necessary to provide two eyelets on the same lever for the two cables associated with the same heald shafts frames. Thus, the fastening of these cables on the ferrules of the eyelets becomes very difficult while, at the same time, the reliability of the securing of the eyelets on the flange of the edge of the levers is considerably reduced.

It must be noted that the stresses applied to the cables are irregular and differ from one cable to the next. The removable fastening pin is thus subjected to bending moments that are added to the vibrations resulting from the high operating speeds, with the result that there is a tendency to let the eyelets slip, running the risk that they to get caught by one lever over another one, taking into account the slight spacing of the levers.

SUMMARY OF THE INVENTION

The present invention has the purpose of remedying these disadvantages, which mainly consists in providing each ferrule with two parallel recessed seatings for the crimping of the two cables fastened to the same heald shafts frame, and to lay out the eyelet in such a manner that it interacts in an interlocking manner with the catching portion of the corresponding suspension lever.

BRIEF DESCRIPTION OF THE DRAWINGS

The attached illustration, given by way of example, allows a better understanding of the invention, of its characteristics and of the advantages it is susceptible to provide.

DESCRIPTION OF THE PREFERRED EMBODIMENT

Figure 1:
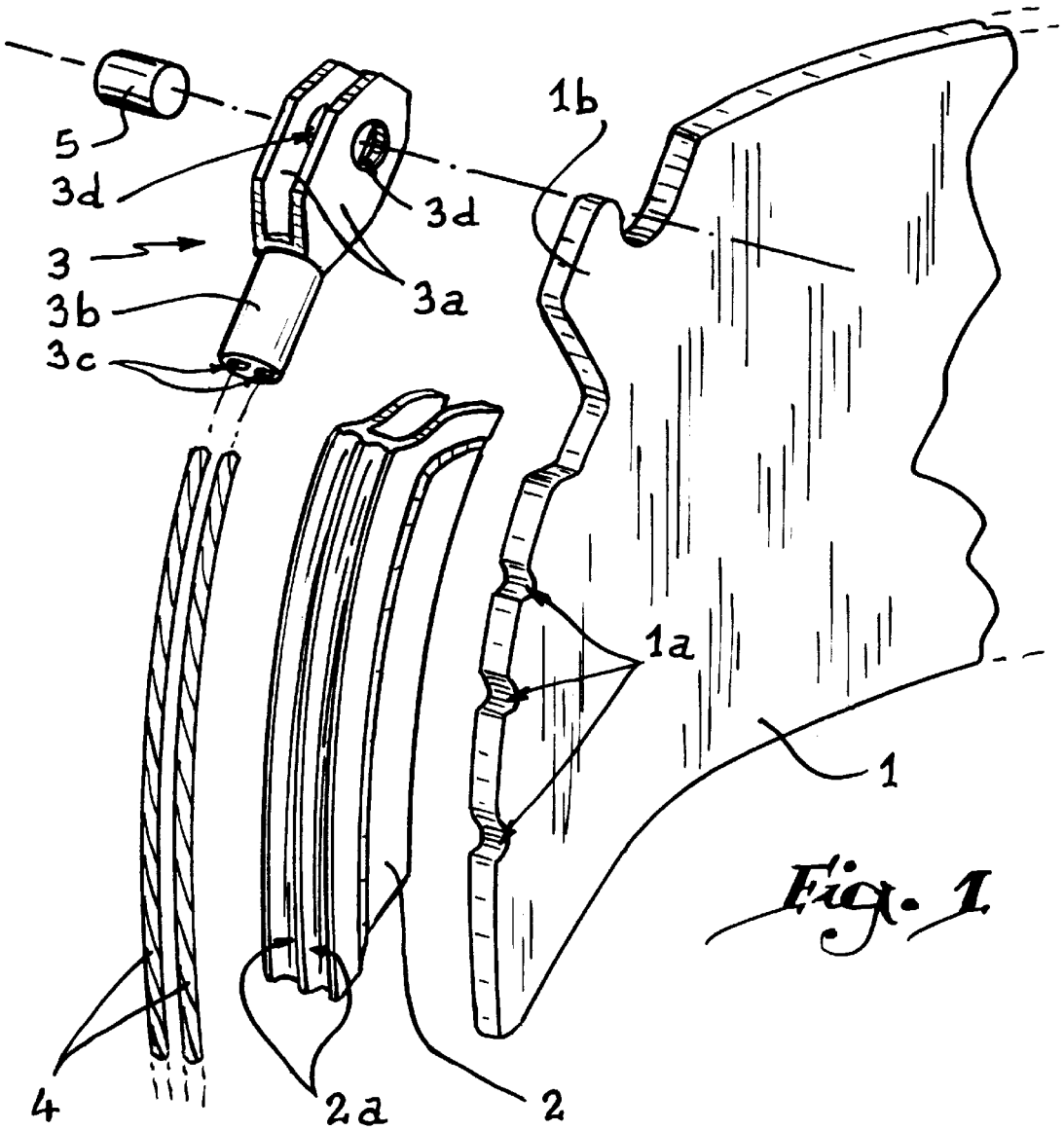
FIG. 1 illustrates a view in perspective showing the various elements, prior to their assembling, that comprise a fastening system provided in accordance with the present invention.
Figure 2:
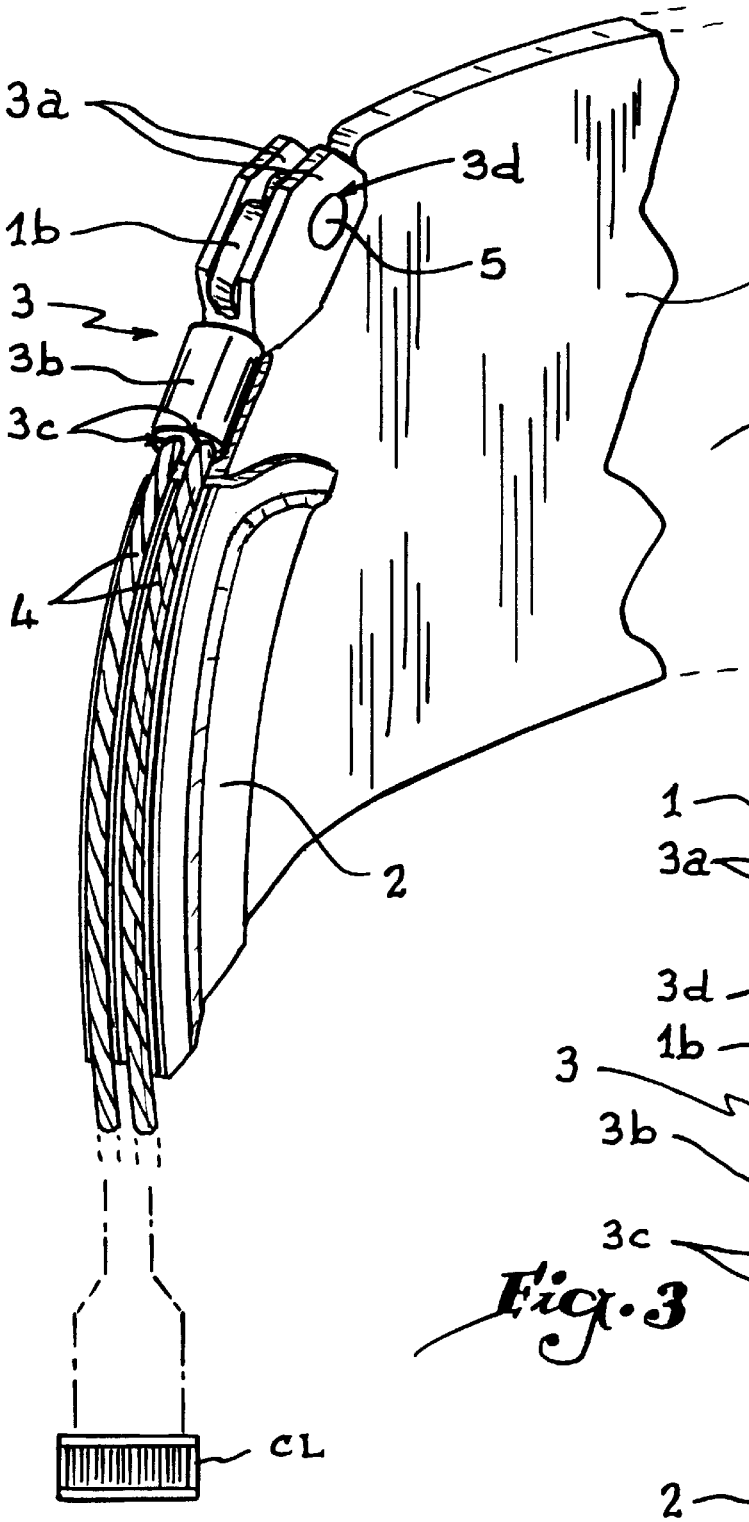
FIG. 2 reproduces FIG. 1 after the assembly and mounting of the constituent elements.
Figure 3:
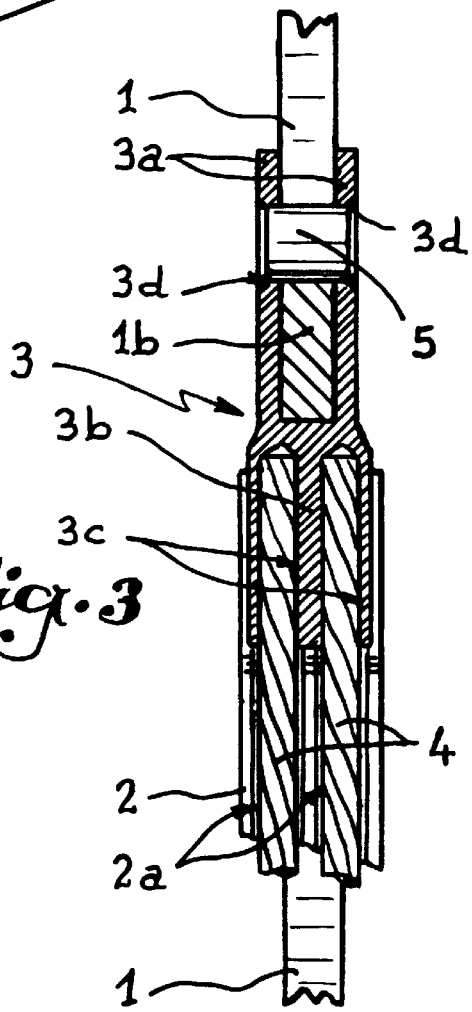
FIG. 3 illustrates a vertical diagrammatic section.

In FIGS. 1 to 3, the reference 1 designates the end of one of the suspension levers of a negative type dobby. On the terminal edge of this lever 1 are provided, on the one hand, a series of depressions or notches 1*a* (three, in the example of embodiment) and, on the other hand, a hook-shaped projection or fastening section 1*b*.

To this arranged lever 1 is associated a curved pad 2, advantageously made out of a plastic material, presenting a U-shaped transversal section. Thus, this pad 2 is susceptible to overlap with a reduced play the terminal edge of the lever 1 on which it is held by means of three bosses provided inside the U interacting with the notches 1*a*. On the other side of the U-section, the pad 2 is provided with two longitudinal grooves 2*a*.

The pad 2 is provided with an eyelet 3 having a stirrup or a yoke shape, the longitudinal flanges 3*a* having the same separation at a very slight clearance near the thickness of the lever 1. The transversal rod that constitutes the back of the stirrup is integral with an axial ferrule 3*b* provided with two parallel recessed seatings 3*c* running parallel to each other for the receiving of the two pulling cables 4 fastened to the same heald shafts frame, as illustrated by CL, which ends are secured by crimping after having been inserted into place.

Lastly, the fastening system comprises an interlocking pin 5 fitted and held in two aligned holes 3*d* bored in the parallel flanges 3*a* of the eyelet 3.

In fact, it can be conceived that once the cables 4 are set into the ferrule 3*b* and the pin 5 is placed and secured to the flanges 3*a* by force fitting or welding, the eyelet 3 is susceptible to straddle the hook-shape projection 1*b* of the lever 1 with its flanges 3*a*, the pin 5 being positioned ahead of the projection 1*b*, as illustrated in FIGS. 2 and 3. Obviously, the pad 2 was first fitted to terminal edge of the lever, the stress exerted on the cables 4 held in the grooves 2*a* ensuring the effectual interaction of the inside bosses of the pad 2 and of the notches 1*a* and, thus, the holding in place of the pad on the lever, such as in the case of the document cited at the beginning of these presents.

The advantages presented by the system in accordance with the present invention with respect to the previous arrangement can be easily understood:

- each cable 4 can be designed with a maximum cross-section because of the fact that its positioning in the direction of the width is fully ensured by the only eyelet 3;
- the mass of the available material for the crimping if the end of each cable 4 in the ferrule 3*b* is increased and brings about a better hold;
- the differences of the tractions between the two cables 4, in particular under the effect of the vibrations become equal at the level of the only eyelet 3 that applies a more normal stress upon the lever 1;
- this eyelet 3 is perfectly centered on the lever 1 as a result of the straddling of the flanges 3*a* on the projection 1*b*, bringing about that it can slip only laterally and that it is susceptible to have a maximum cross-section without running the risk of interfering with the adjacent eyelets 3; and
- lastly, the design of the suspension levers 1 is simplified; they can be obtained by stamping in one only operation without the need for costly machining.

Figure 4:
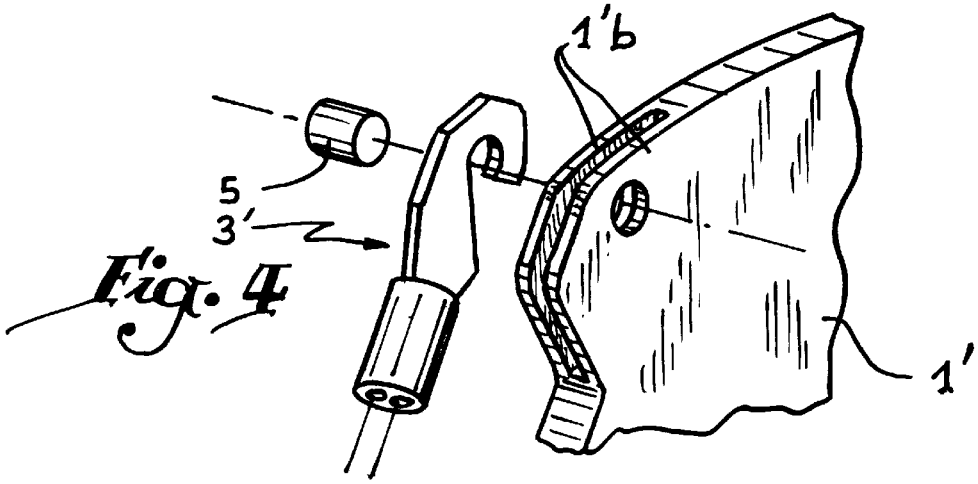
FIG. 4 illustrates in perspective a variant of an embodiment of the present invention.

In spite of this last advantage, for the straddling of the eyelets 3 and for the projections or hooks of the suspension levers one can also adopt the reverse solution to the foregoing, that is to say, and as illustrated in FIG. 4, shape each eyelet in the form of a hook 3' suitable to engage between fastening section consisting of two flanges 1'*b* provided on the terminal edge of the suspension lever 1, these flanges 1'*b* being perforated to receive and hold the interlocking pin 5.

What we claim is:

1. A system for the fastening of pulling cables on suspension levers in dobbies of the negative type to ensure the functioning of heald shaft frames of a loom, and wherein the cables are seated in longitudinal grooves of a pad applied to and held.

2. A system in accordance with claim 1 wherein each eyelet is shaped as a yoke having two flanges for straddling at a reduced clearance a hook-shaped projection which forms said fastening section oriented along the terminal edge of each lever.

3. A system in accordance with claim 2, wherein each eyelet is fastened on the lever by a transversely extending pin means.

4. A system in accordance with claim 1, wherein each eyelet is shaped as a hook of a size to be inserted between two parallel flanges which form said fastening section oriented along the terminal edge of each lever.

5. A system in accordance with claim 4 wherein each eyelet is fastened on the lever by a transversely extending pin means.

* * * * *

UNITED STATES PATENT AND TRADEMARK OFFICE

CERTIFICATE OF CORRECTION

PATENT NO. : 5,964,253
APPLICATION NO. : 09/042533
DATED : October 12, 1999
INVENTOR(S) : Andre Fumex It is certified that error appears in the above-identified patent and that said Letters Patent is hereby corrected as shown below:

Col. 3, line 11, delete claim 1 and replace as follows:

1. A system for the fastening of pulling cables on suspension levers in dobbies of the negative type to ensure the functioning of heald shaft frames of a loom, and wherein the cables are seated in longitudinal grooves of a pad applied to and held against a terminal edge of each suspension lever, the system comprising, an eyelet associated with each suspension lever, each eyelet including a ferrule having two generally parallel recesses therein in which ends of two cables connected to a common heald shaft frame are fixedly secured, each eyelet being connected to a fastening section oriented along the terminal edge of each lever spaced from the pad.

Col. 4, line 4, delete claim 3 and replace as follows:

3. A system in accordance with claim 1 wherein each eyelet is shaped as a hook of a size to be inserted between two parallel flanges which form said fastening section oriented along the terminal edge of each lever.

Col. 4, line 7, delete claim 4 and replace as follows:

4. A system in accordance with claim 2 wherein each eyelet is fastened on the lever by a transversely extending pin means.

Col. 4, line 12, delete claim 5 and replace as follows:

5. A system in accordance with claim 3 wherein each eyelet is fastened on the lever by a transversely extending pin means.

Signed and Sealed this

Eighteenth Day of November, 2008

JON W. DUDAS
*Director of the United States Patent and Trademark Office*